United States Patent [19]

Kohayakawa et al.

[11] 4,171,742

[45] Oct. 23, 1979

[54] CORRUGATED FIBREBOARD BOX

[75] Inventors: Ken Kohayakawa; Atuhiro Sano; Kinichi Araki; Yoshishige Shimizu, all of Kanagawa, Japan

[73] Assignee: Fuji Photo Film Co., Ltd., Minami-ashigara, Japan

[21] Appl. No.: 918,952

[22] Filed: Jun. 26, 1978

[30] Foreign Application Priority Data

Jun. 27, 1977 [JP] Japan ..... 52-76393

[51] Int. Cl.[2] ..... B65D 85/30; B65D 85/62

[52] U.S. Cl. ..... 206/449; 206/455; 206/585; 229/87 R

[58] Field of Search ..... 206/449, 585, 455; 229/87 R

[56] References Cited

U.S. PATENT DOCUMENTS

| | | | |
|---|---|---|---|
| 1,677,918 | 7/1928 | Gallistel | 229/87 R |
| 3,804,237 | 4/1974 | Christensen et al. | 206/585 |

*Primary Examiner*—William T. Dixson, Jr.

[57] ABSTRACT

A corrugated fibreboard shipping box for packing a stack of sheet material stacked into a flat rectangular shape having a certain thickness is made of a single box blank. The box blank is comprised of a rectangular bottom section, a pair of rectangular side sections connected to the opposite sides of the bottom section, a pair of top half sections connected to the sides of the side sections, and flaps connected to the opposite ends of the bottom section, side section and top half sections. The flaps are provided with parallel folding lines at which the flaps are folded inside to form folded end portions. The folded end portions close the open ends of the box. The corrugated fibreboard shipping box packs and protect the stack of sheet materials without pads.

5 Claims, 6 Drawing Figures

CORRUGATED FIBREBOARD BOX

BACKGROUND OF THE INVENTION

1. Field of the Invention

This invention relates to a corrugated fibreboard box, and more particularly to a corrugated fibreboard shipping box for packing a stack of sheet materials of a predetermined number.

2. Description of the Prior Art

In packing a stack of sheet materials such as photosensitive plates consisting of aluminium substrates and photosensitive resin layers disposed thereon, a predetermined number of the sheet materials are stacked together and packed in an interior package and then further packed in a corrugated fibreboard shipping box.

The corrugated fibreboard shipping box (hereinafter referred to simply as "shipping box") comprises a number of pads made of foamed plastics disposed at the corners or sides of the interior package of the stacked sheet materials, a fibreboard wrapping the interior package around its side and end faces, and a fibreboard sleeve covered thereon to cover the exposed remaining two faces of the interior package. The corrugated fibreboard sleeve is fixed to the first fibreboard which wraps the interior package by use of gum tape.

The above-described conventional corrugated fibreboard shipping box has a defect in that the packing work needs a great deal of labor and time and a number of skilled workers because of its troublesome packing system.

It is, therefore, desirable to have a packing system which does not require a great deal of labor and a number of workers and enables an automatic packing operation.

SUMMARY OF THE INVENTION

The object of the present invention is to provide a corrugated fibreboard shipping box which makes it possible to pack the sheet materials by a mechanical packing system.

Another object of the present invention is to provide a corrugated fibreboard shipping box which is able to sufficiently support sheet materials having a comparatively high weight such as photosensitive plates consisting of an aluminium substrate and a photosensitive layer disposed thereon.

The above objects are accomplished by this invention as claimed. That is, in accordance with the present invention as claimed, the automatic packing by use of a packing machine is made possible. Further, the packed sheet materials are well protected from a shock from outside to the side faces of the interior package thereof.

DESCRIPTION OF THE PREFERRED EMBODIMENTS

Figure 1:
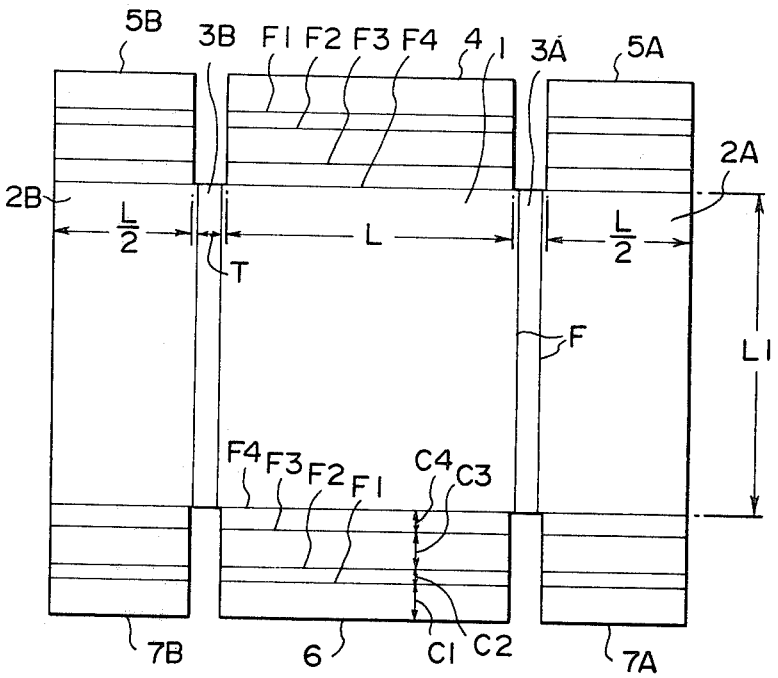
FIG. 1 is a plan view of a box blank of the corrugated fibreboard box in accordance with an embodiment of the present invention.
Figure 2:
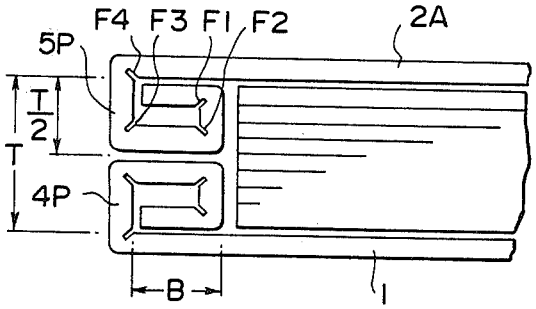
FIG. 2 is a fragmentary sectional view of the corrugated fibreboard box containing a stack of sheet materials in accordance with an embodiment of the present invention as shown in FIG. 1.

Now a preferred embodiment of the present invention will be described in detail with reference to FIGS. 1 to 5. The structure of the corrugated fibreboard shipping box in accordance with an embodiment of the present invention will best be understood referring to FIGS. 1 and 2. Referring to FIG. 1, the box blank comprises a bottom section 1, side sections 3A and 3B connected to the opposite sides of the bottom section 1, top half sections 2A and 2B connected further to the sides of the side sections 3A and 3B, bottom flaps 4 and 6 connected to the opposite ends of the bottom section 1, the top flaps 5A, 7A and 5B, 7B connected to the opposite ends of the top half sections 2A and 2B, respectively. The flaps 4, 6, 5A, 5B, 7A and 7B are provided with parallel fold lines F1, F2, F3 and F4 so that the flaps may be folded inside as shown in FIG. 2. At the ends of the side sections 3A and 3B are formed slots between the adjacent flaps. The folding lines F1 to F4 are provided by use of a slitter-scorer when the box blank is made. The creases between the adjacent sections 1, 3A, 3B, 2A and 2B may also be provided when the box blank is cut out and pressed.

Figure 5:
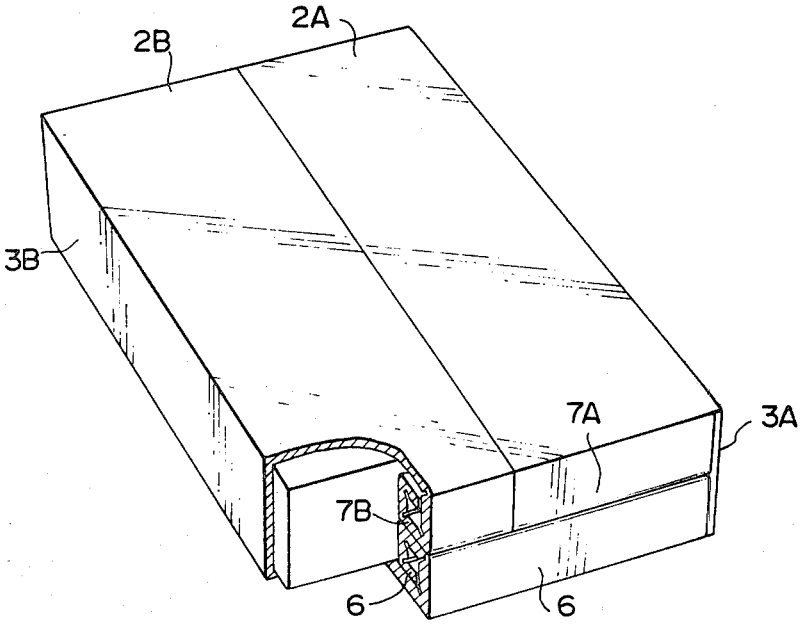
FIG. 5 is a perspective view partly broken away of the corrugated fibreboard shipping box in accordance with the embodiment of the present invention as shown in FIG. 1 in which a stack of sheet materials are contained.

The top section of the corrugated fibreboard shipping box is divided into two top half sections 2A and 2B in order to increase the strength of the box at the both sides of the sheet material on the top of the stack. When the top section is not divided, the top section is sealed to the side section along one side of the top section, which lowers the strength of the box at the side. When the top section is divided into two half sections as shown in FIGS. 1 and 5, the ends of the top half sections 2A and 2B are sealed together at the middle of the top, which increases the strength of the box at the corners or sides on the top thereof.

The flaps 4, 6, 5A, 5B, 7A and 7B are folded inside at the folding lines or scores F1 to F4 as shown in FIG. 2 to form folded end portions 4P and 5P which abut on each other to close an open end of the box.

Figure 3A:
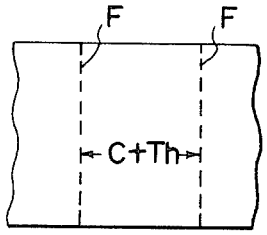
FIG. 3A is a fragmentary plan view showing a part of a corrugated fibreboard.
Figure 3B:
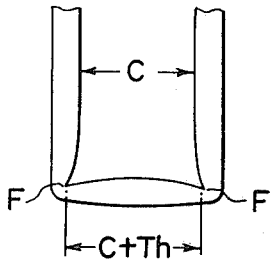
FIG. 3B is a sectional view showing a part of the corrugated fibreboard as shown in FIG. 3A for explaining the dimensions of the corrugated fibreboard when bent.
Figure 4:
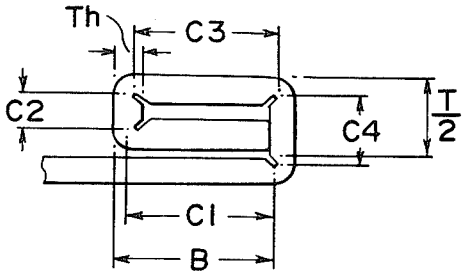
FIG. 4 is an enlarged fragmentary sectional view of the folded portion of the corrugated fibreboard box in accordance with the embodiment of the present invention as shown in FIG. 1.

Now the dimensions of the flaps with scores will be described in detail with reference to FIGS. 3A, 3B and 4. In order that a corrugated fibreboard is folded to provide an inner size of C as shown in FIG. 3B, the fibreboard must be folded or bent at the folding lines F spaced by a distance C plus the thickness of the fibreboard Th as shown in FIG. 3A. When the thickness of the stack of sheet materials to be packed in a shipping box is T, the thickness of the folded end portions 4P and 5P should be T/2 as shown in FIGS. 2 and 4. Assuming now that the thickness of the stack of the sheet material T is four times as large as the thickness of the fibreboard Th, which is normally 3 to 6 mm, that is there is a relationship of $T=4Th$, the dimensions of the spaces between the scores F1 to F4 are calculated to be $C1=B-Th/2$, $C2=Th$, $C3=B$ and $C4=2Th$ as shown in FIG. 4.

By folding the flaps at these scores F1 to F4, the folded end portions having a thickness of $B \times T/2$ can be obtained.

When the cross sectional area of the folded end portions is to be $(B \pm a) \times (T/2 \pm a)$, the spaces C1 and C2 are made to be $(B - Th/2) \pm a$, and $Th \pm a$, wherein "a" is an allowance for error in the thickness of the sheet material and of the fibreboard. The distances C3, C4 are determined on basis of the distances C1, C2 and the thickness of the corrugated fibreboard Th. Thus, the proper distances C1 to C4 can be simply determined in accordance with the thickness of the stack of sheet materials to be packed.

The length L1 of the bottom section 1, side sections 3A and 3B, and top half sections 2A and 2B is made longer than the actual length of the sheet materials to be packed by the length of the folded end portions $B \times 2$ at the opposite ends thereof.

When the corrugated fibreboard shipping box constructed as described above is used for packing a stack of sheet materials, the flaps 4, 6, 5A, 5B, 7A and 7B are at first folded inside to form the folded end portions 4P and 5P (7P is not shown in the drawing.) The strength of the folded end portions can be much increased by applying adhesive on the interior of the flap so that the folded portion is folded tight. The sheet materials are stacked and placed on the center of the bottom section 1 and the folded end portions 4P and 6P are located to hold the stack of sheet materials at the end faces of the stack. Then, the side sections 3A and 3B are bent upward along the side faces of the stack, and then the top half sections 2A and 2B are folded on the top of the stack. The folded end portions 5P and 7P are brought to the position to hold the stack in the placed position as shown in FIGS. 2 and 5. The upper folded end portions 5P and 7P and the lower folded end portions 4P and 6P are bound together by use of adhesive. The top half sections 2A and 2B are bound together by use of a gum tape to completely seal the slit between the top half sections 2A and 2B.

In the above described embodiment of the invention, the flaps are provided with four folding lines or scores F1 to F4. It will be understood, however, that the number of the scores is not limited to four but may be properly selected according to the thickness of the stack of sheet materials.

Further, it is possible to initially provide a number of scores and properly crush some parts between some scores according to the thickness of the stack to be packed, whereby it is prevented to prepare a various kinds of box blanks for different thicknesses of stacks.

In accordance with the present invention, a corrugated fibreboard shipping box which has a function similar to the conventional fibreboard shipping box provided with shock absorbing pads can be obtained only by folding a box blank. Therefore, the troublesome work for preparing a number of pads and adhering the pads to the predetermined positions of the box can be omitted.

Further, in accordance with the corrugated fibreboard shipping box of this invention, the edges and corners of the packed stack of sheet materials are well protected. In addition, the folded end portions formed by the flaps at both of the ends of the top half sections and the bottom section are more advantageous than the folded end portions formed only one of the bottom section and the top half sections in that the strength thereof is improved. Therefore, by the folded end portions having such a high strength is sufficiently able to protect the stack of sheet materials having a large weight such as the photosensitive plates consisting of an aluminium substrate and a photosensitive layer disposed thereon.

We claim:

1. A corrugated fibreboard shipping box for packing and protecting an article having a flat rectangular shape and a predetermined thickness, said box being made from a material having a certain thickness and comprising a rectangular bottom section, a pair of rectangular side sections connected to first opposite parallel sides of the bottom section and extending perpendicular to the bottom section, a pair of first rectangular flaps connected to second opposite parallel ends of the bottom section, a pair of top half sections connected to the sides of the side sections parallel to the first opposite sides of the bottom section and extending in parallel to the bottom section, said top half sections having a width the sum of which is equal to the width of the bottom section, folding lines extending between said bottom and side sections and between said side sections and said top half sections, the spacing between said folding lines substantially equalling the thickness of said article plus the thickness of said material, and two pairs of second rectangular flaps each connected to opposite ends of the pair of top half sections, said first and second flaps each having four substantially parallel spaced folding lines at which the flaps are folded to form folded end portions to close opposite open ends of the box, the sum of the thickness of the folded end portions connected to the bottom section and the thickness of the folded end portions connected to the top half sections being equal to the thickness of the article to be packed, the spacing between adjacent folding lines of said four folding lines, starting with the folding line most remote from said bottom and top half sections respectively equalling:the thickness of the article minus one half the thickness of the material; the thickness of the material; the thickness of the article; and twice the thickness of the material.

2. A corrugated fibreboard shipping box as claimed in claim 1 in which said top half sections are rectangular in shape.

3. A corrugated fibreboard shipping box as claimed in claim 2 in which each of said top half sections has a width half of the width of the bottom section.

4. A corrugated fibreboard shipping box as claimed in claim 1 in which said flaps have parallel folding lines.

5. A corrugated fibreboard shipping box as claimed in claim 1 in which said flaps are applied with adhesive and bound together after folded.

* * * * *